US010982368B2

(12) United States Patent
Cho

(10) Patent No.: US 10,982,368 B2
(45) Date of Patent: Apr. 20, 2021

(54) METHOD FOR MANUFACTURING WATER-REPELLENT KNITTED FABRIC AND WATER-REPELLENT KNITTED FABRIC

(71) Applicant: Eun Hyo Cho, Seoul (KR)

(72) Inventor: Eun Hyo Cho, Seoul (KR)

( * ) Notice: Subject to any disclaimer, the term of this patent is extended or adjusted under 35 U.S.C. 154(b) by 822 days.

(21) Appl. No.: 14/775,718

(22) PCT Filed: Mar. 12, 2014

(86) PCT No.: PCT/KR2014/002073
§ 371 (c)(1),
(2) Date: Sep. 13, 2015

(87) PCT Pub. No.: WO2014/142554
PCT Pub. Date: Sep. 18, 2014

(65) Prior Publication Data

US 2016/0032511 A1 Feb. 4, 2016

(30) Foreign Application Priority Data

Mar. 14, 2013 (KR) ..... 10-2013-0027288

(51) Int. Cl.
*D06B 21/00* (2006.01)
*D06B 3/10* (2006.01)
(Continued)

(52) U.S. Cl.
CPC ..... *D06B 21/00* (2013.01); *D04B 1/00* (2013.01); *D06B 3/10* (2013.01); *D06B 15/00* (2013.01);
(Continued)

(58) Field of Classification Search
CPC ..... D06B 21/00; D06B 3/10; D06B 15/00; D04B 1/00; D06M 11/00; D06M 23/16; D06P 5/02
(Continued)

(56) References Cited

U.S. PATENT DOCUMENTS 7,578,148 B2 * 8/2009 McMurray ..... D04B 1/18 66/172 E
2010/0011482 A1 * 1/2010 Chang ..... A41B 1/00 2/116
2014/0335294 A1 * 11/2014 Cho ..... D06B 3/10 428/35.2

FOREIGN PATENT DOCUMENTS

KR 10-2003-0097421 A 12/2003
KR 10-2004-0042756 A 5/2004
(Continued)

OTHER PUBLICATIONS

Machine translation of KR101165931B1.*
(Continued)

*Primary Examiner* — Vincent Tatesure
(74) *Attorney, Agent, or Firm* — Revolution IP, PLLC

(57) ABSTRACT

Provided is a method for manufacturing a water-repellent knitted fabric and a water-repellent knitted fabric. The method includes: dyeing a yarn; obtaining a knitted fabric by knitting the dyed yarn which is dyed in the dyeing of the yarn; dipping the knitted fabric in a water-repellent liquid to allow the water-repellent liquid to penetrate into a structure of the dyed yarn and to be coated on a surface of the dyed yarn; dehydrating the knitted fabric after the dipping of the knitted fabric and then incompletely drying the knitted fabric while moisture remains in the dyed yarn; adhering the water-repellent liquid applied to the knitted fabric by applying heat to the knitted fabric after the dehydrating of the knitted fabric; washing the knitted fabric using water after
(Continued)

the adhering of the water-repellent liquid; and drying the knitted fabric after the washing of the knitted fabric.

3 Claims, 7 Drawing Sheets

(51) Int. Cl.

| | |
|---|---|
| ***D06B 15/00*** | (2006.01) |
| ***D06M 15/70*** | (2006.01) |
| ***D04B 1/00*** | (2006.01) |
| ***D06M 23/16*** | (2006.01) |
| ***D06P 5/02*** | (2006.01) |

(52) U.S. Cl.
CPC ..... *D06M 15/70* (2013.01); *D06M 23/16* (2013.01); *D06P 5/02* (2013.01); *D06M 2200/01* (2013.01); *D06M 2200/11* (2013.01); *D06M 2200/12* (2013.01); *D10B 2201/02* (2013.01); *D10B 2501/00* (2013.01); *D10B 2501/02* (2013.01)

(58) Field of Classification Search
USPC ..... 442/79
See application file for complete search history.

(56) References Cited

FOREIGN PATENT DOCUMENTS

| | | | |
|---|---|---|---|
| KR | 10-2005-0069183 | A | 7/2005 |
| KR | 10-0817787 | B1 | 3/2008 |
| KR | 10-1165931 | B1 | 7/2012 |
| KR | 101165931 | B1 * | 7/2012 |

OTHER PUBLICATIONS

English Abstract of KR101165931B1.*
International Search Report for PCT/KR2014/002073 dated Jun. 26, 2014 from Korean Intellectual Property Office.

* cited by examiner

【Figure 1】
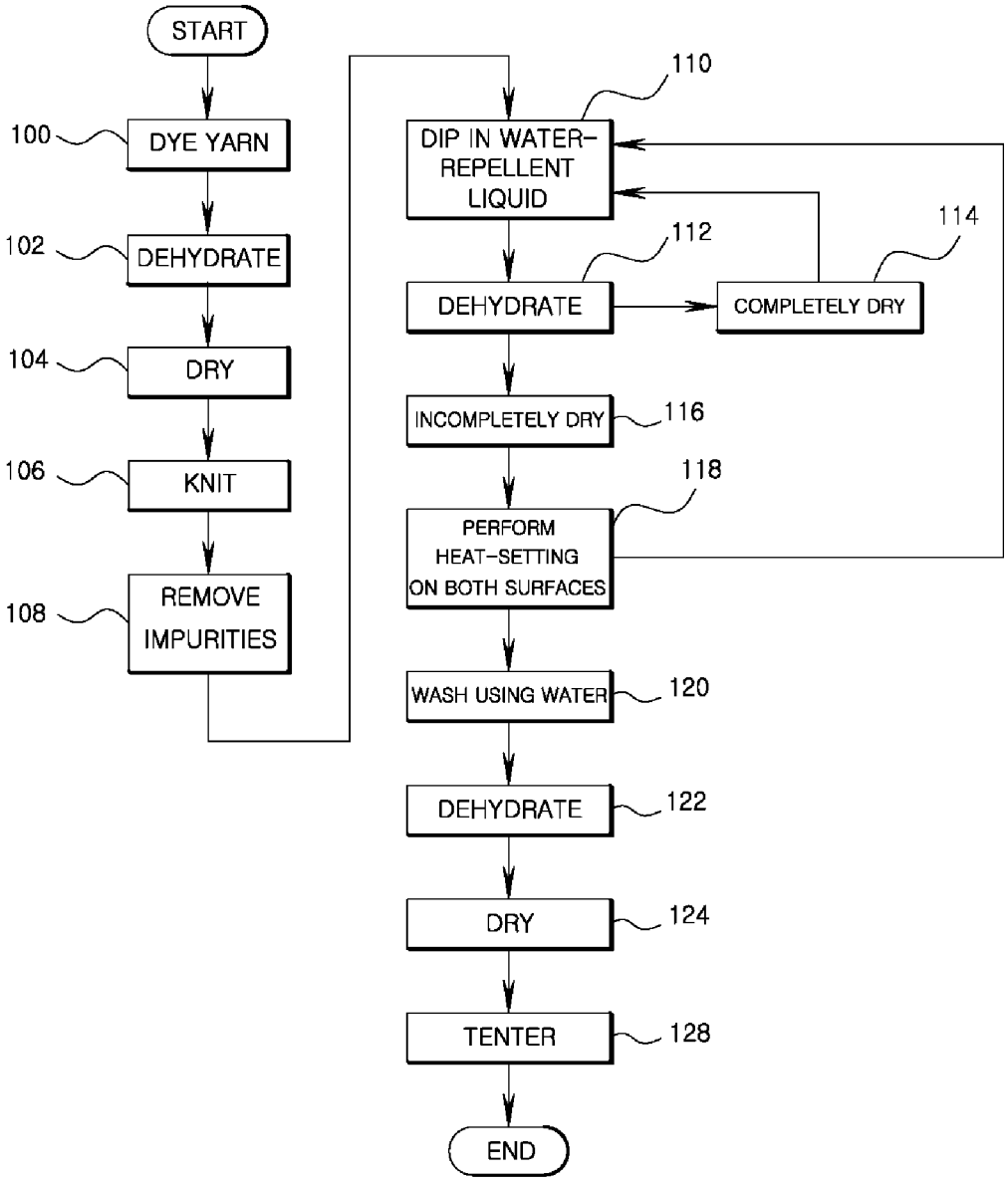

【Figure 2】
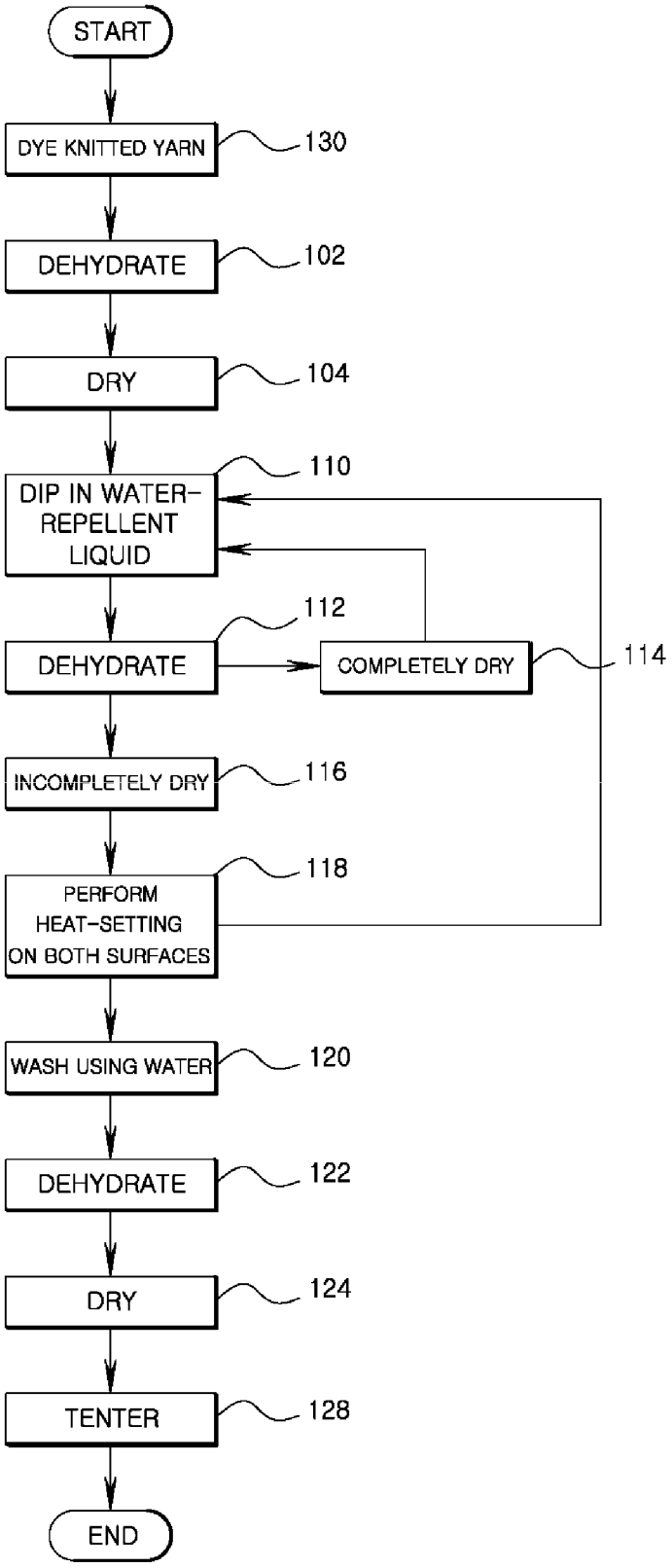

【Figure 3】
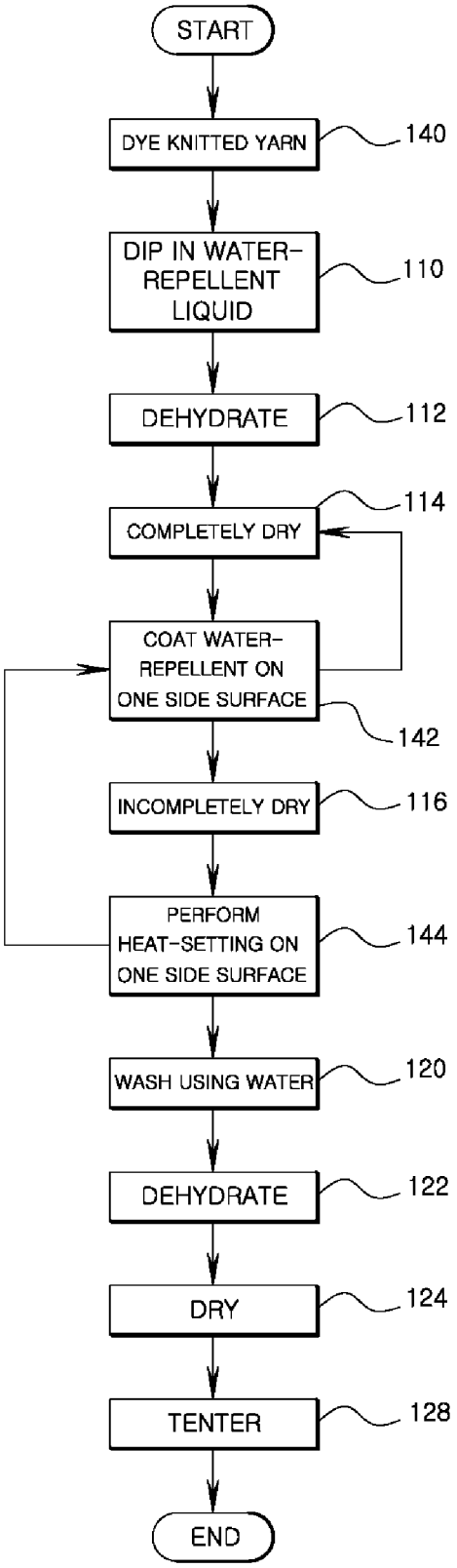

【Figure 4】
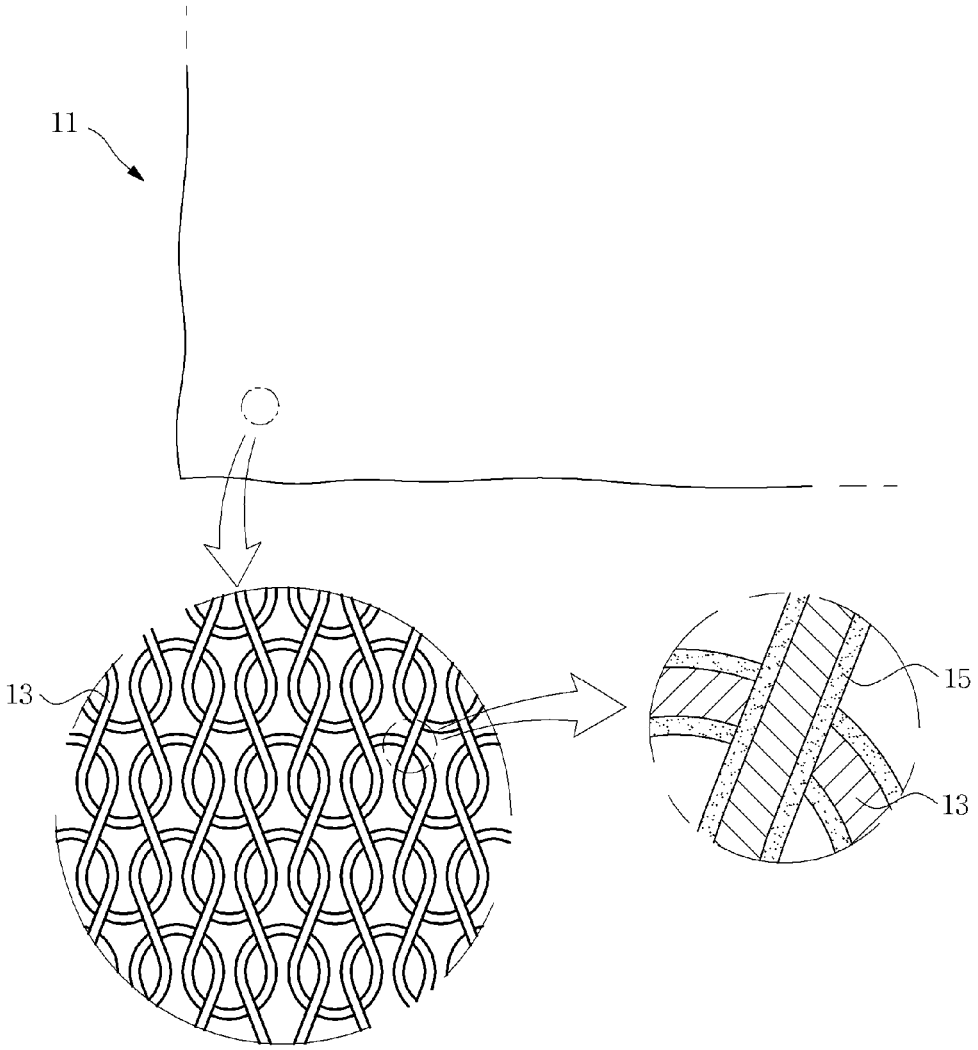

【Figure 5】
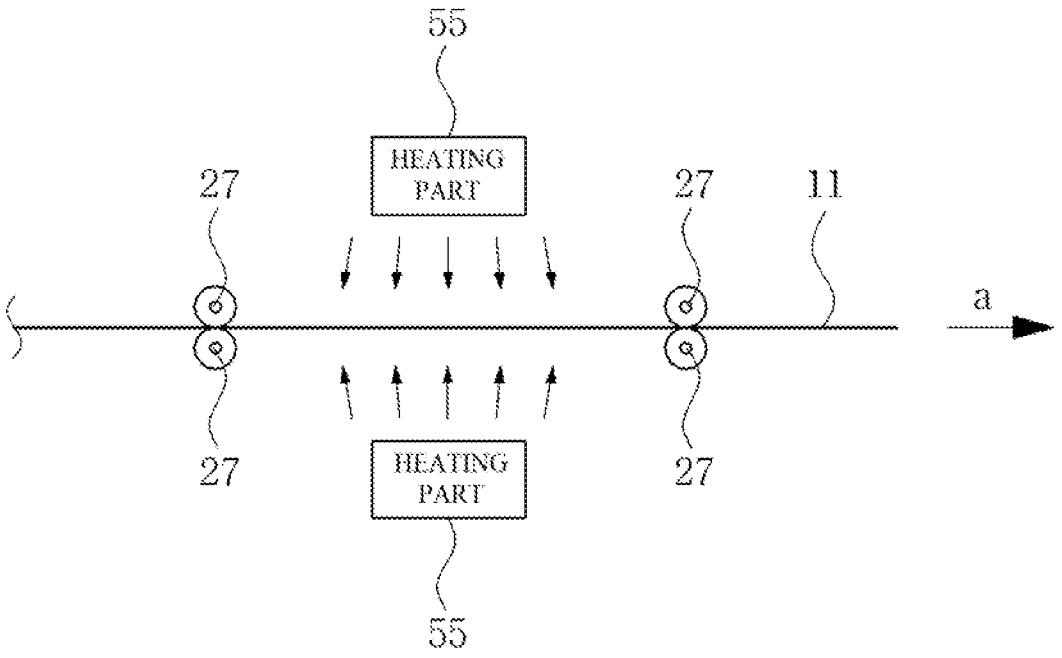
【Figure 6】
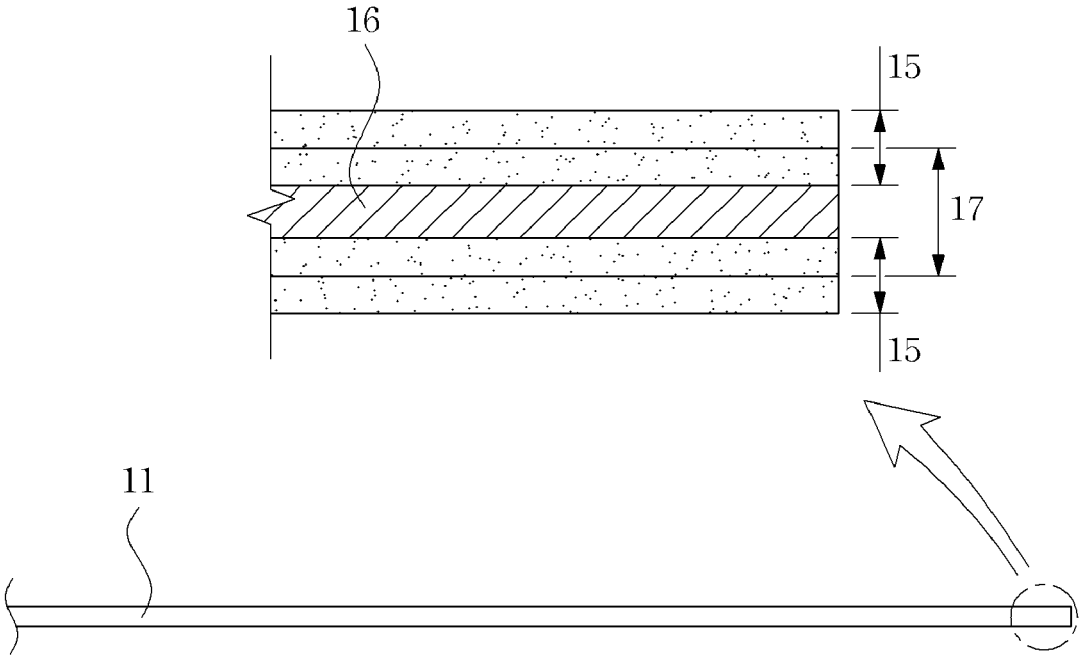

【Figure 7】
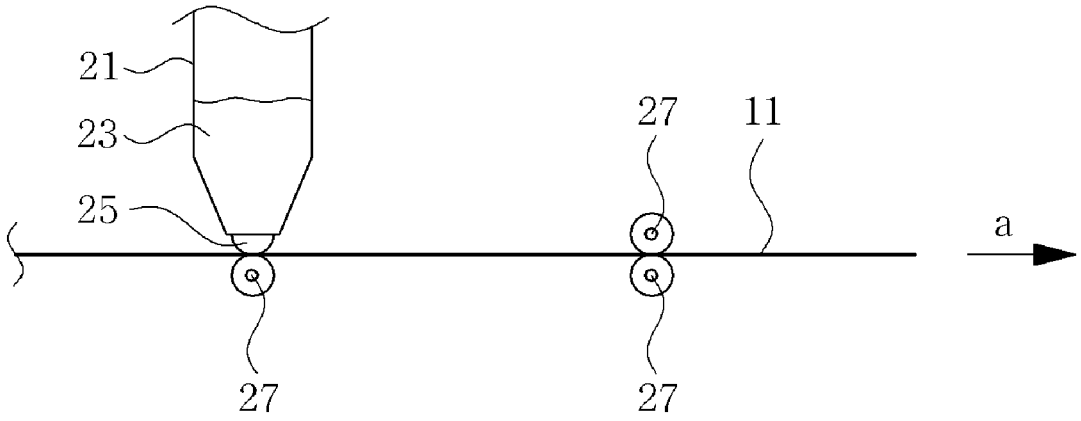
【Figure 8】
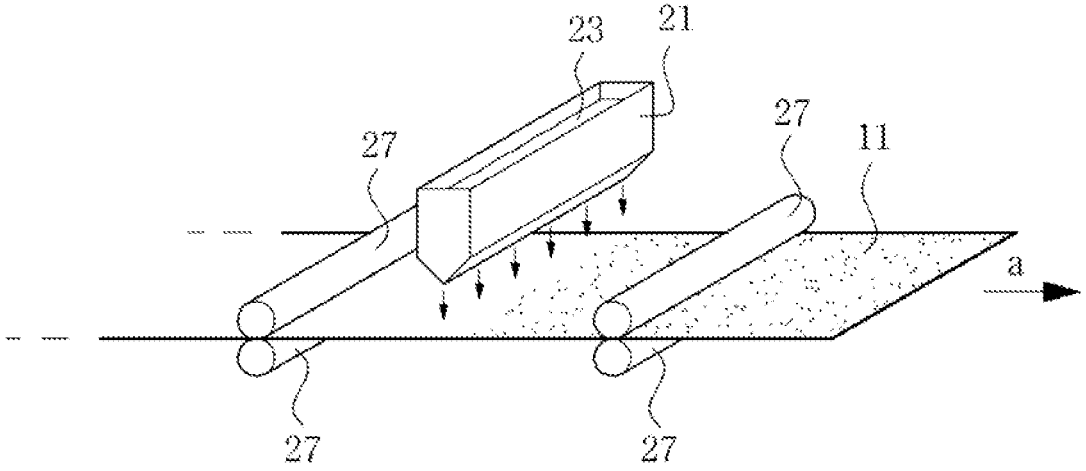
【Figure 9】
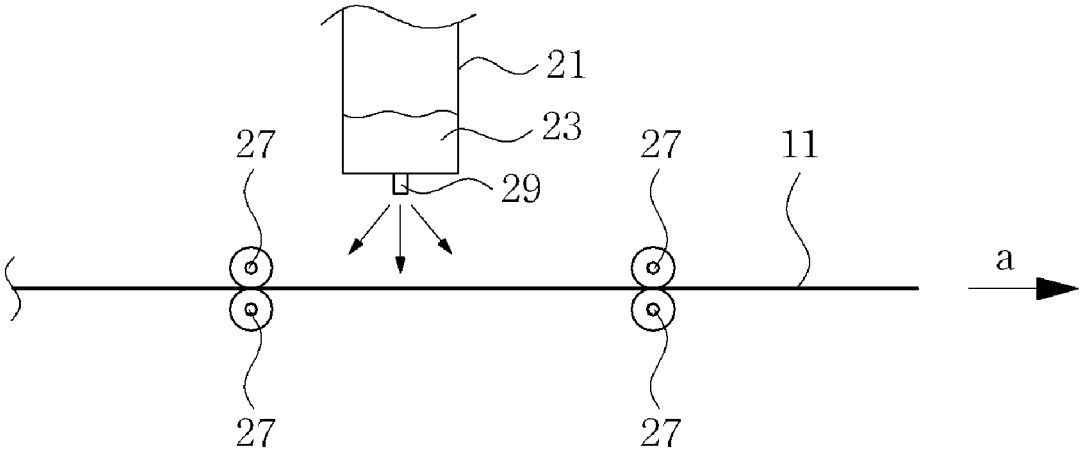

【Figure 10】
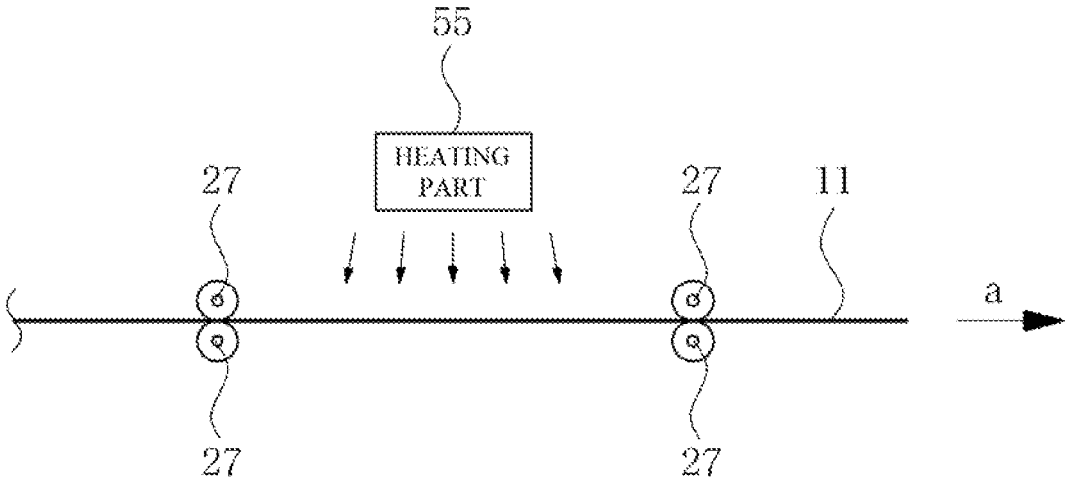
【Figure 11】
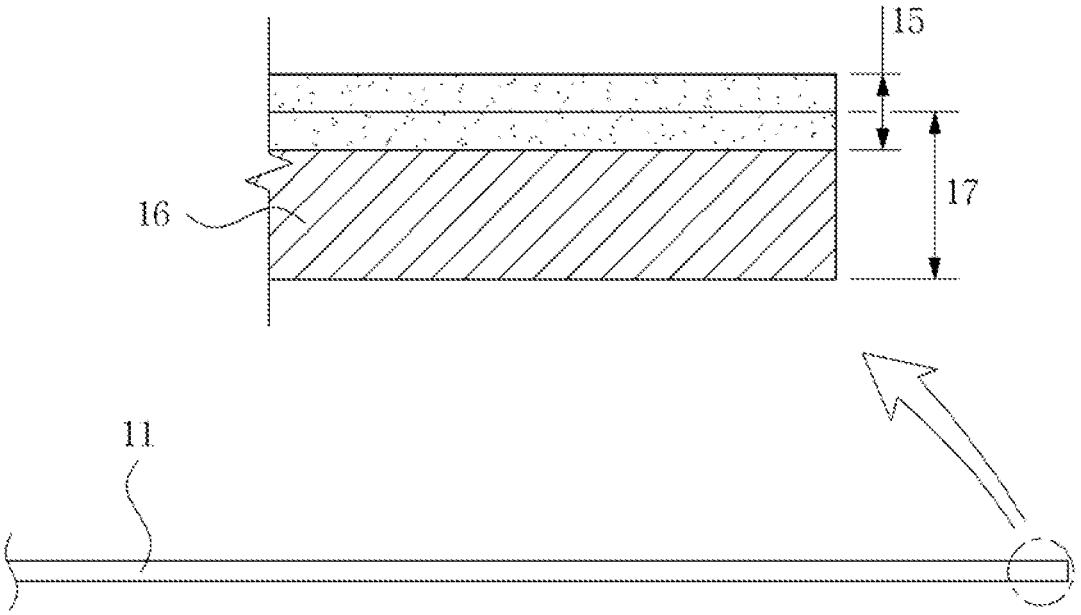

METHOD FOR MANUFACTURING WATER-REPELLENT KNITTED FABRIC AND WATER-REPELLENT KNITTED FABRIC

CROSS REFERENCE TO PRIOR APPLICATIONS

This application is a National Stage Application of PCT International Patent Application No. PCT/KR2014/002073 filed on Mar. 12, 2014, under 35 U.S.C. § 371, which claims priority to Korean Patent Application No. 10-2013-0027288 filed on Mar. 14, 2013, which are all hereby incorporated by reference in their entirety.

BACKGROUND OF THE INVENTION

The present invention disclosed herein relates to a method for manufacturing a water-repellent knitted fabric and a water-repellent knitted fabric.

Fiber is classified into natural fibers and synthetic fibers (artificial fibers) in accordance with the composition of raw materials. Also, among chemical fibers, fiber in which synthetic polymer synthesized and polymerized from compounds of low molecular weight is used as a raw material is referred to as synthetic fibers.

The synthetic fibers have slightly different properties according to the type thereof. Also, compared to the natural fibers, the synthetic fibers have a strong structure and good wear resistance. In addition, the synthetic fibers are resistant and tough to tension and friction, and are not well wrinkled. For example, due to their low hygroscopic property, the synthetic fibers maintain lightness without becoming heavy even in a highly humid environment. Along with the development of the fiber technology, in recent years, high-performance synthetic fibers that do not lose waterproof and windproof properties even in extreme conditions are being actively developed.

Also, there are many types of natural fibers which are strong and durable, and have excellent durability to repeated washing compared to synthetic fibers. Moreover, natural fibers are hygienic and comfortable due to good absorption, thermokeeping and tactile feeling compared to synthetic fibers.

Natural fibers or synthetic fibers are being widely used for fabric through knitting.

Compared with woven fabric manufactured by the intersection of the warp and weft, since fabric manufactured through the knitting process has a structure that continuously connects a loop using yarns of vertical or horizontal direction, the fabric has good elasticity and is very comfortable without constraining the body of a wearer during the activity. Accordingly, fabric is applied to almost sportswear, and fabric including natural fiber is used as materials of clothing such as underclothing, brassiere, girdles, tights, socks, and gloves.

However, since knitted fabric including natural fiber has hydrophilicity easily absorbing moisture even though having the above advantages, there is an inconvenience in that knitted fabric can be contracted by easily holding moisture in some cases. Particularly, sportswear is easily wet with sweat during the game. In this case, if sportswear is wet with sweat, the activity of the body is reduced. In addition, since moisture can easily penetrate into the fine fibrous structure of the synthetic fiber, knitted fabrics formed of synthetic fibers tend to be wet.

In order to overcome this limitation, various technologies have been proposed to prevent moisture from penetrating fabric by imparting water repellency to the knitted fabric. For example, Korean Patent Application No. 10-2003-97421 discloses a composition having a composition having water-repellent, anti-fouling, and oil-repellent functions and an apparatus for spraying the composition. However, the composition and the apparatus are not strongly fixed to the structure of the fabric, but perform only temporary coating. Accordingly, there is a limitation in that water repellency performance after washing is rapidly reduced as time goes on.

SUMMARY OF THE INVENTION

The present invention provides a method for manufacturing water-repellent knitted fabric and a water-repellent knitted fabric, which has good and long breathable water-repellent ability because water-repellent liquid penetrates into and adheres to the structure of yarn constituting the knitted fabric, and can be comfortably worn without poor wearing sensation even though manufactured into underwear because water-repellent liquid can selectively adhere to both surfaces or only outer surface of the knitted fabric.

Embodiments of the present invention provide methods for manufacturing a water-repellent knitted fabric, including: dyeing a yarn; obtaining a knitted fabric by knitting the dyed yarn which is dyed in the dyeing of the yarn; dipping the knitted fabric in a water-repellent liquid to allow the water-repellent liquid to penetrate into a structure of the dyed yarn and to be coated on a surface of the dyed yarn; dehydrating the knitted fabric after the dipping of the knitted fabric and then incompletely drying the knitted fabric while moisture remains in the dyed yarn; adhering the water-repellent liquid applied to the knitted fabric by applying heat to the knitted fabric after the dehydrating of the knitted fabric; washing the knitted fabric using water after the adhering of the water-repellent liquid; and drying the knitted fabric after the washing of the knitted fabric.

In other embodiments of the present invention, methods for manufacturing a water-repellent knitted fabric, include: dyeing a knitted fabric knitted with a yarn; dipping the knitted fabric dyed through the dyeing of the knitted fabric in a water-repellent liquid to allow the water-repellent liquid to penetrate into a structure of the yarn and to be coated on a surface of the yarn; dehydrating the knitted fabric after the dipping of the knitted fabric and then incompletely drying the knitted fabric while moisture remains; adhering the water-repellent liquid applied to the knitted fabric by applying heat to the knitted fabric after the dehydrating of the knitted fabric; washing the knitted fabric using water after the adhering of the water-repellent liquid; and drying the knitted fabric after the washing of the knitted fabric.

In still other embodiments of the present invention, methods for manufacturing a water-repellent knitted fabric, include: dipping a knitted fabric that is dyed into a water-repellent liquid to allow water-repellent liquid to penetrate into a yarn constituting the knitted fabric and to be coated on a surface of the yarn; completely drying the knitted fabric after the dipping of the knitted fabric; coating the water-repellent liquid on one side surface of the knitted fabric after the complete drying of the knitted fabric; incompletely drying the knitted fabric after the coating of the water-repellent liquid while moisture remains; adhering the water-repellent liquid to one side surface of the knitted fabric by heating the one side surface coated with the water-repellent liquid after the incomplete drying of the knitted fabric;

washing the knitted fabric using water after the adhering of the water-repellent liquid; and drying the knitted fabric after the washing of the knitted fabric.

In some embodiments, the adhering of the water-repellent liquid may include adhering the water-repellent liquid to both side surfaces of the knitted fabric by applying heat on the both side surfaces of the knitted fabric.

In other embodiments, the coating of the water-repellent liquid may include applying and stacking the water-repellent liquid onto one side surface of the knitted fabric that is being transferred while being stretched.

In still other embodiments, the adhering of the water-repellent liquid may include adhering the water-repellent liquid to one side surface of the knitted fabric by applying heat on the one side surface of the knitted fabric while the knitted fabric, the one side surface of which is applied with the water-repellent liquid, is being transferred.

In even other embodiments of the present invention, water-repellent knitted fabrics are manufactured by methods for manufacturing a water-repellent knitted fabric, including: dyeing a yarn; obtaining a knitted fabric by knitting the dyed yarn which is dyed in the dyeing of the yarn; dipping the knitted fabric in a water-repellent liquid to allow the water-repellent liquid to penetrate into a structure of the dyed yarn and to be coated on a surface of the dyed yarn; dehydrating the knitted fabric after the dipping of the knitted fabric and then incompletely drying the knitted fabric while moisture remains in the dyed yarn; adhering the water-repellent liquid applied to the knitted fabric by applying heat to the knitted fabric after the dehydrating of the knitted fabric; washing the knitted fabric using water after the adhering of the water-repellent liquid; and drying the knitted fabric after the washing of the knitted fabric.

In yet other embodiments of the present invention, water-repellent knitted fabrics are manufactured by methods for manufacturing a water-repellent knitted fabric, include: dyeing a knitted fabric knitted with a yarn; dipping the knitted fabric dyed through the dyeing of the knitted fabric in a water-repellent liquid to allow the water-repellent liquid to penetrate into a structure of the yarn and to be coated on a surface of the yarn; dehydrating the knitted fabric after the dipping of the knitted fabric and then incompletely drying the knitted fabric while moisture remains; adhering the water-repellent liquid applied to the knitted fabric by applying heat to the knitted fabric after the dehydrating of the knitted fabric; washing the knitted fabric using water after the adhering of the water-repellent liquid; and drying the knitted fabric after the washing of the knitted fabric.

In further embodiments of the present invention, water-repellent knitted fabrics are manufactured by methods for manufacturing a water-repellent knitted fabric, include: dipping a knitted fabric that is dyed into a water-repellent liquid to allow water-repellent liquid to penetrate into a yarn constituting the knitted fabric and to be coated on a surface of the yarn; completely drying the knitted fabric after the dipping of the knitted fabric; coating the water-repellent liquid on one side surface of the knitted fabric after the complete drying of the knitted fabric; incompletely drying the knitted fabric after the coating of the water-repellent liquid while moisture remains; adhering the water-repellent liquid to one side surface of the knitted fabric by heating the one side surface coated with the water-repellent liquid after the incomplete drying of the knitted fabric; washing the knitted fabric using water after the adhering of the water-repellent liquid; and drying the knitted fabric after the washing of the knitted fabric.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings:

FIG. 1 is a view illustrating a method for manufacturing a water-repellent knitted fabric according to a first embodiment of the present invention;

FIG. 2 is a view illustrating a method for manufacturing a water-repellent knitted fabric according to a second embodiment of the present invention;

FIG. 3 is a view illustrating a method for manufacturing a water-repellent knitted fabric according to a third embodiment of the present invention;

FIG. 4 is a view illustrating an exemplary basic structure of a water-repellent knitted fabric according to an embodiment of the present invention;

FIG. 5 is a view illustrating heat setting in methods for manufacturing a water-repellent knitted fabric according to first and second embodiments of the present invention;

FIG. 6 is a view illustrating a cross-sectional shape of a knitted fabric manufactured by methods according to first and second embodiments of the present invention;

FIGS. 7 to 9 are views illustrating various methods of a one-side water repellent liquid coating process according to a third embodiment of the present invention;

FIG. 10 is a view illustrating a one-side heat setting method according to a third embodiment of the present invention; and FIG. 11 is a view illustrating a cross-sectional shape of a knitted fabric manufactured by methods according to a third embodiment of the present invention.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

FIG. 1 is a view illustrating a method for manufacturing a water-repellent knitted fabric according to a first embodiment of the present invention.

As shown in FIG. 1, the method for manufacturing the water-repellent knitted fabric according to the first embodiment starts with a yarn dyeing step 100 for dyeing the yarn. The yarn may be a 100% natural fiber, and may also be a mixed spinning of synthetic fibers and natural fibers. Also, the yarn may also be a 100% synthetic fiber. In case of mixed spinning, the mixing ratio of synthetic fibers and natural fibers may be modified in various ways.

In the yarn dyeing step 100, there may be various dyeing methods. For example, yarn may be put into a dyeing tank in a cone state, and then a dye may be injected into the dyeing tank, or yarn may be put into the dyeing tank in a hank state and then may be dyed. The type and color of dyeing liquid may be selectively determined according to the need.

When the yarn dyeing step 100 is completed, a dehydration step 102 may be simultaneously performed to remove surplus dyeing liquid, and a drying step 104 for drying the dyed yarn may be performed. In the drying step 104, various drying methods may be implemented in various ways.

When the dyed yarn from which moisture is removed is obtained through the drying step 104, a knitting step 106 may be performed. In the knitting step 106, knitted fabric may be obtained by knitting the dyed yarn. In other words, the knitting step 106 may be a process in which fabric is manufactured by knitting the yarn using a knitting machine while forming and weaving loops. In this disclosure, the knitted yarn denotes a yarn that is knitted goods manufactured through the knitting process.

When the knitting step 108 is completed, an impurity removing step 108 may be performed to remove impurities from the knitted yarn, and then a water-repellent liquid dipping step 110 may be performed.

In the water-repellent liquid dipping step 110, the knitted fabric may be dipped into a water-repellent liquid that is prepared to allow water-repellent liquid to penetrate into the structure of the yarn constituting the knitted fabric and thus to be coated on the surface of fiber of the yarn. In this case, the concentration of water-repellent liquid used may vary with the type and thickness of the yarn. Accordingly, the dipping time of the knitted fabric in the water-repellent liquid may range from about 30 minutes to about 40 minutes. However, the dipping time may be changed according to the concentration of the water-repellent liquid or whether or not an additive catalyst is added.

After the water-repellent liquid dipping step 110, a dehydration step 112 may be performed. The dehydration step 112 may be a process for removing water-repellent liquid remaining after penetration, adsorption and coating of water-repellent liquid, by lifting the knitted fabric holding the water-repellent liquid therein from the water-repellent liquid. The dehydration step 112 may also be performed like the yarn dehydration step 102 which is described above, in addition to a centrifugal hydration method.

When the dehydration step 112 is completed, a complete drying step 114 or an incomplete drying step 116 may be performed. Whether to perform the complete drying step 114 or the incomplete drying step 116 may be determined according to the degree of water repellency of the knitted fabric and the requirements of an orderer.

In other words, when the degree of water repellency performed in the water-repellent liquid dipping step 110 does not satisfy a required value, the dehydration step 112, the complete drying step 114, and then the water-repellent liquid dipping step 110 may be repeated. When the water repellency treatment is sufficiently performed, the incomplete drying step 116 may be performed.

The complete drying step 114 may be a process for repeating the water-repellent liquid dipping step 110. In other words, the complete drying step 114 may be performed after the dehydration step 112 in order to repeat the water-repellent liquid dipping step 110 two or more times. That is, when the water-repellent liquid dipping step 110 needs to be again performed because the degree of water repellency is insufficient after the dehydration step 112, the water-repellent liquid dipping step 110 may be repeated whenever the yarn is completely dried.

In the incomplete drying step 116, the knitted fabric may be put and dried in a drying apparatus, and may not be completely dried but may be dried such that moisture partially remains in the yarn. In the incomplete drying step 116, the dehydration rate may vary with the type of fabric, and may range from about 50% to about 80%.

When the incomplete drying step 116 is completed, a both-side heat setting step 118 may be performed. In the both-side heat setting step 118, the knitted fabric (11 of FIG. 5) permeated with water-repellent liquid may be transferred while being spread out, and heat may be applied to both surfaces (outer surface and inner surface) of the knitted fabric 11 to allow water-repellent liquid to adhere to the both surfaces of the knitted fabric 11. The adhering water-repellent liquid may firmly remain even after a water washing process 120 described later, forming a water repellent coating layer (15 of FIG. 6).

The heating method for performing the both-side heat setting step 118 may be variously applied using various heating devices in addition to a tenter setting device. For example, a heating device as shown in FIG. 5 may be used.

FIG. 5 is a view illustrating heat setting in methods for manufacturing a water-repellent knitted fabric according to first and second embodiments of the present invention.

As shown in FIG. 5, the knitted fabric 11 that has undergone the incomplete drying step 116 may be transferred in the arrow (a) direction while being supported by a plurality of feeding rollers 27, and heating parts 55 may be disposed over and under the transfer path of the knitted fabric 11.

The heating parts 55 may be heaters disposed in a vertical direction, and may apply heat of about 150° C. to about 200° C. to both side surfaces of the knitted fabric 11, allowing water-repellent liquid to adhere to the both surfaces of the knitted fabric 11.

The both-side heat setting step 118 using the heating parts 55 may be performed for about 2 minutes to about 20 minutes. However, the heating temperature and the heating time may vary with the mixture rate of materials constituting the knitted fabric 11 or the thickness and type of the knitted fabric 11.

Particularly, after the both-side heat setting step 118, when the adhesion degree of water-repellent liquid to the knitted fabric 11 is insufficient according to the type and thickness or weight of materials and needs to be further strengthened, the water-repellent liquid dipping step 110 may start again. In other words, the knitted fabric 11 that has undergone the both-side heat setting step 118 may be again dipped into water-repellent liquid, and may again pass through the water-repellent liquid dipping step 110, the dehydration step 112, incomplete drying step 116, and the both-side heat setting step 118.

When heat setting is sufficiently performed through the repeated processes, a water washing step 120 may be performed. In the water washing step 120, the knitted fabric to which water-repellent liquid adheres may be dipped in water including a fabric softener that does not impair the water-repellency performance, and may be washed for softening treatment.

During the water washing process, water-repellent liquid that does not adhere to the yarn of the knitted fabric may be removed by water, and the touch feeling (tactile feeling) may be improved.

While water-repellent liquid may be strongly adhered to the both side surfaces of the knitted fabric 11 through the both-side heat setting step 118, water-repellent liquid may be relatively weakly adhered to the central portion of the knitted fabric 11. Accordingly, water-repellent liquid in the central portion of the knitted fabric 11 may be washed away, allowing the knitted fabric 11 to have a cross-sectional shape as shown in FIG. 6.

FIG. 6 is a view illustrating a cross-sectional shape of a knitted fabric manufactured by methods according to first and second embodiments of the present invention.

As shown in FIG. 6, a water repellent coating layer 15 may be formed on both side surfaces of a knitted fabric 17 having a certain thickness. The water repellent coating layer 15 may be formed through the both-side heat setting step 118.

A non-water repellent layer 16 may remain between the water repellent coating layers 15. If necessary, the non-water repellent layer 16 may be removed by controlling the thickness of the water repellent coating layer 15. In other words, the water repellent coating layer 15 may be formed so as to having a larger thickness and heat setting may be more strongly performed. Thus, the water repellent coating layer 15 may completely pass through the knitted fabric in the thickness direction, being integrated into one.

After the water washing step 120, water may be removed from the knitted fabric through a dehydration step 122, and then a drying step 124 may be performed. The dehydration step 122 may be performed similarly to the dehydration step 102 described above. Also, in the drying step 124, the knitted fabric 11 that has undergone the dehydration may be dried using a drying device such as a steam dryer or a hot-air dryer.

Next, a tentering step 128 may be performed. In the tentering step 128, the knitted fabric 11 may be transferred and heated in a longitudinal direction while being tightly stretched in a width direction using a tenter device. The process of manufacturing the water-repellent knitted fabric according to this embodiment may be finished through the tentering step 128.

FIG. 2 is a view illustrating a method for manufacturing a water-repellent knitted fabric according to a second embodiment of the present invention.

Hereinafter, the same reference numerals as the reference numerals described above denote the same processes or steps, and detailed descriptions thereof will be omitted.

As shown in FIG. 2, a method for manufacturing a water-repellent knitted fabric according the second embodiment of the present invent may start with a knitted fabric dyeing step 130 for dyeing a knitted fabric knitted with natural fiber, synthetic fiber, or a mixed yarn of natural fiber and synthetic fiber.

In the knitted fabric dyeing step 130, there may be various dyeing methods. For example, a knitted fabric to be dyed may be dipped in a tank storing dyeing liquid for a certain time. The type and color of dyeing liquid may be selectively determined according to the need.

When the knitted fabric dyeing step 130 is completed, a dehydration step 102 and a drying step 104 for removing dyeing liquid from the knitted fabric that is dyed may be sequentially performed, and then a water-repellent liquid dipping step 110 may be performed.

In the water-repellent liquid dipping step 110, the knitted fabric that is dyed may be dipped into a water-repellent liquid that is prepared to allow water-repellent liquid to penetrate into the structure of the yarn constituting the knitted fabric and to be coated on the surface of the yarn.

If the water-repellent liquid dipping step 110 is completed, then a dehydration step 112, a complete drying step 114, an incomplete drying step 116, a both-side heat setting step 118, a water washing step 120, a dehydration step 122, a drying step 124, and a tentering step 128 may be sequentially performed to obtain a water-repellent knitted fabric 11. The processes after the water-repellent liquid dipping step 110 may be similar to those described in the first embodiment.

FIG. 3 is a view illustrating a method for manufacturing a water-repellent knitted fabric according to a third embodiment of the present invention.

The method for manufacturing the water-repellent knitted fabric according to the third embodiment may start with a dyed knitted fabric preparing step 140. The dyed knitted fabric may be a knitted fabric that is already dyed.

The dyed knitted fabric, as described in the first embodiment, may be obtained by knitting a yarn that is first dyed, and as described in the second embodiment, may also be obtained by dyeing a knitted fabric that is manufactured by knitting a yarn.

When the dyed knitted fabric is prepared, water repellency treatment may be performed on the dyed knitted fabric through a water-repellent liquid dipping step 110. In other words, the knitted fabric that is dyed may be dipped into a water-repellent liquid to allow water-repellent liquid to penetrate into the yarn constituting the knitted fabric and to be coated on the surface of the yarn.

When the water-repellent liquid dipping step 110 is completed, a dehydration step 112 and a complete drying step 114 may be sequentially performed, and then a one-side water repellent liquid coating step 142 may be performed.

In the one-side water repellent liquid coating step 142, water-repellent liquid may be coated on one side surface (outer surface) of the knitted fabric that has undergone the complete drying step 114. The one-side water repellent liquid coating may be implemented in various methods, and the method shown in FIGS. 7 to 9 may be applied.

FIGS. 7 to 9 are views illustrating various methods of one-side water repellent liquid coating step 142 according to the third embodiment of the present invention.

Referring to FIG. 7, the knitted fabric 11 may move in the arrow (a) direction while passing through a coating roller 25 and a plurality of feeding rollers 27.

The coating roller 25 may rotate while being disposed under a water-repellent liquid container 21 supplied with water-repellent liquid 23, and may coat water-repellent liquid on the knitted fabric 11. The feeding roller disposed under the coating roller 25 may support the knitted fabric 11 toward the coating roller 25, and may allow the knitted fabric 11 to move in the right direction.

Accordingly, the knitted fabric 11 may be coated with water-repellent liquid by the coating roller 25 while passing between the feeding roller 27 and the coating roller 25. That is, water-repellent liquid may be coated on one side surface of the knitted fabric 11.

Unlike the roller coating method shown in FIG. 7, water-repellent liquid may be dropped on one side surface of the knitted fabric 11 that is being transferred.

In other words, as shown in FIG. 8, the water-repellent liquid container 21 may be disposed over the transfer path of the knitted fabric 11, and a desired amount of water-repellent liquid 23 may be dropped from the water-repellent liquid container 21 to coat water-repellent liquid on one side surface of the knitted fabric 11. In this case, the concentration and the coating amount of water-repellent liquid may be controllable.

As shown in FIG. 9, water-repellent liquid may be sprayed through an injection nozzle instead of dropping on one side surface of the knitted fabric 11. In other words, the injection nozzle 29 may spray the water-repellent liquid 23 on the one side surface of the fabric while the knitted fabric 11 is being transferred in the arrow (a) direction. Thus, one-side coating may be performed.

In addition to the methods of FIGS. 7 to 9, other coating methods may be applied.

Also, the one-side water repellent liquid coating step 142 may be repeated according to the need. For example, when a desired degree of coating is not achieved according to the material, thickness and weight of the fabric in spite of performance of the one-side water repellent liquid coating step 142, the complete drying step 114 may be again performed to dry the one-side coating layer, and then the one-side water repellent liquid coating step 142 may be repeated.

Thus, when one-side coating is sufficiently performed through the above processes, an incomplete drying step 116 may be performed. In the incomplete drying step 116, as described above, the knitted fabric, one-side coating of which is completed, may be put and dried in a drying apparatus, and may not be completely dried but may be dried such that moisture partially remains in the yarn. In the incomplete drying step 116, the dehydration rate may vary with the material and type of fabric, and may range from about 50% to about 80%.

When the incomplete drying step 116 is completed, a one-side heat setting step 144 may be performed. In the one-side heat setting step 144, heat may be applied to one side surface of the knitted fabric coated with water-repellent liquid to allow water-repellent liquid to adhere to the knitted fabric. Particularly, during the one-side heat setting step 144, heat may be blocked from be applied to the other side surface of the knitted fabric surface which is not coated with water-repellent liquid in order to interrupt adhesion of water-repellent liquid.

The one-side heat setting step 144 may also be implemented in various methods, and for example, may be performed using the roller type of heating device shown in FIG. 10.

FIG. 10 is a view illustrating the one-side heat setting method according to the third embodiment of the present invention.

As shown in FIG. 10, the knitted fabric 11, one-side water repellent liquid coating of which is completed, may be transferred in the arrow (a) direction by a plurality of feeding rollers 27, and a heating part 55 may be disposed over the knitted fabric 11. The heating part 55 may apply heat to the top surface, i.e., one side surface of the knitted fabric 11, coated with one side water-repellent liquid to allow water-repellent liquid to adhere to the spot. This adhesion method may be similar to those described with reference to FIG. 5.

In addition, although the heating part 55 is simply described as being applied in FIG. 10, a net setting device including an insulating material may also be applied. Also, a separate insulating device (not shown) may be disposed such that heat cannot reach the undersurface of the knitted fabric 11. That is, thermal energy radiating from the heating part 55 may be allowed to affect only the top surface of the knitted fabric 11.

When sufficient coating quality cannot be obtained in spite of performance of the one-side heat setting step 144, the one-side water repellent liquid coating step 142 may be repeatedly performed.

When the one-side heat setting step 144 is completed, the water washing step 120, the dehydration step 122, the drying step 124 and the tentering step 128 may be sequentially performed. Particularly, during the water washing step 120, water-repellent liquid applied to the non-coating surface of the fabric which is not coated with water-repellent liquid may be simply separated from the fabric while going through the water washing process, on the ground that heat treatment was not performed.

FIG. 11 is a view illustrating a cross-sectional view of the water-repellent knitted fabric that has undergone the water washing step 120 after the one-side heat setting step 144.

As shown in FIG. 11, a water repellent coating layer 15 may remain on one side surface of a knitted fabric 17 having a certain thickness. The water repellent coating layer 15 may be disposed on one side surface (outer surface) of the knitted fabric 17, providing water-repellent ability against the outside.

Also, a non-water repellent layer 16 may be disposed in the knitted fabric 17. The non-water repellent layer 16 may correspond to the spot from which water-repellent liquid is washed away through the water washing step 120, and may be disposed at an inner surface of the fabric. When clothes are manufactured with the knitted fabric 11, clothes may be manufactured such that the non-water repellent layer 16 makes contact with the skin. Since the non-water repellent layer 16 has moisture absorbing ability due to the characteristics of natural fiber, the non-water repellent layer 16 may provide comfortable wearing sensation by absorbing sweat away from the body.

The one-side water repellent knitted fabric 11 manufactured through the above processes can be manufactured so as to retain and maintain the unique moisture absorbing function of fiber, by applying a relatively larger amount of water-repellent liquid to one side surface of the knitted fabric 11 than to the other side surface and more strongly performing heat setting on one side surface thereof, and particularly, by maximally interrupting application of heat to the other side surface when heat setting for adhering water-repellent liquid to the fabric is performed.

FIG. 4 is a view illustrating an exemplary basic structure of a water-repellent knitted fabric 11 according to an embodiment of the present invention.

As shown in FIG. 4, a yarn 13 constituting the water-repellent knitted fabric 11 may be coated with a water repellent coating layer 15. The water repellent coating layer 15 may be firmly coated on the yarn 13 having a moisture absorbing property to provide water-repellent and anti-staining characteristics. Also, moisture can pass through a gap between the yarns 13 of the knitted fabric 11.

Although a weft knitting structure is shown in the drawing, the present invention can be applied to a warp knitting structure.

Particularly, since the water repellent coating layer 15 has an anti-staining characteristic, clothes manufactured with the water-repellent knitted fabric 11 may not be easily contaminated. This means that clothes do not have to be frequently washed. Generally, clothes may be easily damaged by friction during washing. As described above, when the washing cycle increases, the lifespan of clothes can significantly increase, and water used for washing may also be reduced as much.

On the other hand, the test report attached below shows the test results of a water-repellent knitted fabric according to an embodiment of the present invention, performed by Korean Textile Inspection & Testing Institute (KOTITI).

<TEST REPORT>
KOTITI NO: 1319001892
Reception: THE FIRST JEANS
Title: Circulate Test Report
Sample: Knitted Fabric
Received date: 2013 Jan. 18
Issued date: 2013 Jan. 24

| | |
|---|---|
| Sample Name | 100% Cotton Knitted Fabric |
| Buyer | G S Home Shopping |
| Brand Label | N/A |
| Style No. | N/A |
| P.O. No. | N/A |
| Previous Report No. | N/A |
| Color | (A) White |
| Mixture Ratio Proposed | 100% Cotton |
| Mixture Ratio Recommended | N/A |
| Washing Handling Mark Proposed | N/A |
| Washing Handling Mark Recommended | N/A |
| Test Result | See Attachment |
| DIRECTOR of KOTITI | |

| Test Item | Test Result | Standard |
|---|---|---|
| Water Repellency Degree (KS K 0590:2008) (After Washing Twenty times) | (A) | |
| 3 | | |
| 3 | | |
| 3 | | |

Note)
Washing by Machine, (30 ± 3)° C., Dried on Clothesline Twenty times, KS K ISO 6330:2011

As described in the test report, the water-repellency of the water-repellent knitted fabric shows water-repellency equal to or less than third grade after washing twenty times. For reference, the formal test standard for inspecting the water-repellent performance has five stages. The fifth grade shows about 100% water-repellent performance after washing twenty times, and the fourth grade shows about 90% after washing twenty times. Also, the third grade shows about 80% after washing twenty times, and the second grade shows about 70% after washing twenty times. Finally, the first grade shows about 60% or less water-repellent performance after washing twenty times.

Consequently, the water-repellent knitted fabrics according to the embodiments of the present invention have third graded water-repellent performance. Particularly, in case of one-side water-repellent knitted fabric, since water-repellent liquid does not remain on the inner side surface thereof, the inner side surface of the water-repellent knitted fabric may have absorption characteristics instead of water-repellency. Accordingly, when the inner side surface of the water-repellent knitted fabric is used for clothes, the water-repellent knitted fabric can absorb moisture or sweat from the body.

A water-repellent knitted fabric according to an embodiment of the present invention has good and long breathable water-repellent ability because water-repellent liquid penetrates into and adheres to the structure of yarn constituting the knitted fabric. Also, the water-repellent knitted fabric can be comfortably worn without poor wearing sensation even though manufactured into underwear because water-repellent liquid can selectively adhere to both surfaces or only outer surface of the knitted fabric.

The above-disclosed subject matter is to be considered illustrative and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A method for manufacturing a water-repellent knitted fabric, consisting of:

knitting a fabric using a knitting machine while forming and weaving any two loops having any one or more physical properties as being the same, wherein the fabric is made of a single type of yarn selected from a natural fiber or a synthetic fiber;

dipping the knitted fabric that is dyed into a water-repellent liquid to allow water-repellent liquid to penetrate into the single type of yarn constituting the knitted fabric and to be coated on a surface of the single type of yarn;

completely drying the knitted fabric after the dipping of the knitted fabric;

coating the water-repellent liquid on one side surface of the knitted fabric after the complete drying of the knitted fabric by moving the knitted fabric in one direction while passing through a coating roller and a feeding roller, wherein the coating roller rotates while being disposed under a water-repellent liquid container supplied with water-repellent liquid, and coats the water-repellent liquid on the one side surface of the knitted fabric, wherein the feeding roller disposed under the coating roller supports the knitted fabric toward the coating roller, and allows the knitted fabric to move in the one direction;

incompletely drying the knitted fabric after the coating of the water-repellent liquid while moisture remains;

adhering the water-repellent liquid to one side surface of the knitted fabric by heating the one side surface coated with the water-repellent liquid after the incomplete drying of the knitted fabric so that a water repellent coating layer is formed on the one side surface of the knitted fabric;

washing away the water-repellent liquid in the knitted fabric using water after the adhering of the water-repellent liquid; and drying the knitted fabric after the washing of the knitted fabric, wherein a non-water repellent layer is disposed in the knitted fabric, the non-water repellent layer corresponding to a spot from which the water-repellent liquid is washed away through the washing away step, and being disposed at an inner surface of the knitted fabric.

2. The method of claim 1, wherein the coating of the water-repellent liquid comprises applying and stacking the water-repellent liquid onto one side surface of the knitted fabric that is being transferred while being stretched.

3. The method of claim 2, wherein the adhering of the water-repellent liquid comprises adhering the water-repellent liquid to one side surface of the knitted fabric by applying heat on the one side surface of the knitted fabric while the knitted fabric, the one side surface of which is applied with the water-repellent liquid, is being transferred.

* * * * *